US008146397B2

(12) United States Patent
Penttilä et al.

(10) Patent No.: US 8,146,397 B2
(45) Date of Patent: Apr. 3, 2012

(54) SUPPORT ARRANGEMENT OF ROLL IN FIBROUS-WEB MACHINE

(75) Inventors: Kimmo Penttilä, Helsinki (FI); Marko Jorkama, Järvenpää (FI); Heikki Föhr, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 915 days.

(21) Appl. No.: 12/143,179

(22) Filed: Jun. 20, 2008

(65) Prior Publication Data

US 2008/0315057 A1 Dec. 25, 2008

(30) Foreign Application Priority Data

Jun. 21, 2007 (FI) ..... 20075476

(51) Int. Cl.
*B21B 31/07* (2006.01)

(52) U.S. Cl. ..... 72/246; 72/245; 72/244; 100/169

(58) Field of Classification Search ..... 72/237, 72/238, 244, 245, 246; 100/162 B, 169, 100/170

See application file for complete search history.

(56) References Cited

U.S. PATENT DOCUMENTS

| | | | | | |
|---|---|---|---|---|---|
| 2,506,525 | A | * | 5/1950 | Thomas et al. | 384/558 |
| 3,060,843 | A | * | 10/1962 | Moore et al. | 100/41 |
| 3,285,049 | A | * | 11/1966 | Neumann | 72/246 |
| 3,929,389 | A | * | 12/1975 | Riegler et al. | 384/29 |
| 4,580,429 | A | * | 4/1986 | Gilvar | 72/238 |
| 4,796,452 | A | | 1/1989 | Schiel | |
| 4,837,907 | A | * | 6/1989 | Roerig et al. | 492/7 |
| 4,915,024 | A | | 4/1990 | Wanke | |
| 5,261,324 | A | * | 11/1993 | Jakobs et al. | 100/158 R |
| 5,395,172 | A | | 3/1995 | Grabscheid | |
| 5,495,798 | A | * | 3/1996 | Niskanen et al. | 100/162 B |
| 5,860,322 | A | * | 1/1999 | Grabscheid et al. | 74/421 R |
| 5,865,112 | A | * | 2/1999 | Grabscheid et al. | 100/168 |

FOREIGN PATENT DOCUMENTS

| | | | |
|---|---|---|---|
| FI | 83993 B | | 6/1991 |
| FI | 94458 B | | 5/1995 |
| JP | 55-24706 | * | 2/1980 |
| JP | 03-082843 | | 4/1991 |
| WO | 98/49394 A1 | | 11/1998 |
| WO | 00/04227 A1 | | 1/2000 |
| WO | 00/04228 A1 | | 1/2000 |

OTHER PUBLICATIONS

Search Report issued in FI 20075476.
Office Action issued in FI 20075476.

* cited by examiner

*Primary Examiner* — Edward Tolan
(74) *Attorney, Agent, or Firm* — Stiennon & Stiennon

(57) ABSTRACT

A support arrangement (10) of a roll of a fibrous-web machine, has a first frame part (12) in which the roll (20) of the fibrous-web machine is supportable from its end when in use and a second frame part (22) in which the first frame part (12) is fastened by means of an elastic fastening. The arrangement has a motion direction control arrangement (34) for controlling the direction of the motion allowed by the elastic fastening in a way determined by the direction control arrangement (34).

15 Claims, 4 Drawing Sheets

SUPPORT ARRANGEMENT OF ROLL IN FIBROUS-WEB MACHINE

CROSS REFERENCES TO RELATED APPLICATIONS

This application claims priority on Finnish Application No. FI 20075476, Filed Jun. 21, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a support arrangement of a roll in a fibrous-web machine. The invention generally relates to supporting a bearing of a roll of a fibrous-web machine or an equivalent shaft to the frame structure. Particularly, the invention relates to a roll of a device or a section of a paper or board machine and supporting its bearing to the frame structure when external force applies to the roll. Such external force can be caused e.g. by another roll, a support fabric or a web reel.

The vibration of rolls is a great problem with present-day fibrous-web machines, inter alia, due to the increase in operating speed. Traditionally, the rolls are fastened in the foundation as rigidly as possible, this is particularly the case with the carrier rolls of a slitter-winder.

Specifications WO9849394, WO0004227 and WO0004228 describe arrangements in which in the bearing housing of a roll of a paper machine has been arranged a tunable vibration damper. In the arrangements presented in the specifications, the tuning of the frequency of the vibration being damped has been implemented by changing the position of the mass in the vibrating rod or, alternatively, by changing the volume of the mass. When the access to the damper is relatively easy, the tuning can be changed even during the operation of the machine. In these, the damper is outside the roll, whereby it, inter alia, occupies considerable space. This kind of an arrangement does not always provide good enough damping.

FI patent 94458 describes a method and apparatus for controlling the vibration of the rolls of a paper machine. In the method, the positions of the critical speed ranges of the roll are changed during run. Critical speed is changed by changing the mass and/or the rigidity of the roll and/or the support point of the roll. As a possibility is presented changing the rigidity of the end bearing of the roll. Between the washer of the bearing housings of the end bearings and the frame, intermediate pieces of elastic material can be installed. By adjusting the force with which the bearing housing presses the intermediate pieces against the frame, it is possible to adjust the rigidity of the fastening of the bearing housings. Said pressing force can be adjusted by means of a cylinder device or a screw. A problem of such an arrangement is, however, that simultaneously as the critical speed ranges are changed by making the support elastic, the static rigidity of the support suffers. Particularly in such an arrangement, the static rigidity of the support also weakens in such directions in which it is not desired. This causes problems particularly in targets demanding accurate setting, such are e.g. nip contacts between the rolls and between the roll and the web reel.

Specification JP 3082843 describes an arrangement for minimizing vibrations in a roll. The drive motor of the roll is elastically fastened in the frame. The fastening comprises a rubber intermediate piece enduring vibration between the base plate of the fastening part and the frame. The fastening bolts of the base plate extend through the frame plate into a cylinder fastened on the lower surface of the frame plate in which they are fastened in a piston in the cylinder. Below the fastening bolt heads, there are rubber sleeves, whereby the fastening of the base plate is provided floating. On the inner surface of the cylinder, there is a projection which limits the upward motion of the piston in the cylinder. Between the cylinder ceiling and the upper surface of the piston, there is a spring and, between the lower surface of the piston and the bottom of the cylinder, there is a pressure space in which compressed air is the pressure medium. The piston is run with compressed air first against the projection of the inner surface of the cylinder, whereby minimum pressing force is applied on the rubber intermediate pieces and sleeves. When the pressure of compressed air below the piston is decreased, the piston moves downwards from the force of the spring being above the piston, whereby greater pressing force is applied on the rubber intermediate pieces and rubber sleeves. With the pressure of pressure medium being below the piston, it is then possible to adjust the rigidity of the fastening of the roll. A problem of the arrangement presented in this specification is also that making the support more elastic causes easily that elasticity, particularly its direction, is not sufficiently controlled.

SUMMARY OF THE INVENTION

The object of the invention is to provide a support arrangement of a roll of a fibrous-web machine, which arrangement comprises a first frame part in which the roll is supportable from its end and a second frame part in which the first frame part is fastened by means of an elastic fastening, which support arrangement with allowed elasticity has at least one certain determined direction and which is substantially statically rigid in other directions.

This object is achieved according to the invention such that the support arrangement comprises a motion direction control arrangement for controlling the direction of the motion allowed by the elastic fastening in a way determined by the direction control arrangement.

With this arrangement, such an effect is achieved that in the support the dampening of vibration is provided effective without endangering the rigidity of the support in such directions which require rigidity.

A direction control arrangement of a support arrangement of a roll according to an embodiment of the invention comprises at least one support part which is fastened in both the first frame part and the second frame part. The support part is arranged according to the invention substantially perpendicular in relation to the direction allowed by elasticity and it is thin in the direction allowed by elasticity. A support part arranged this way prevents the mutual motion of the first piece and the second piece mainly in other than the substantially perpendicular direction in relation to the plane of the support part.

Advantageously, the thin support part is a piece having a long deformation zone. The thickness of the support part is typically at the most 10% of the length of its deformation zone.

In a support arrangement of a roll according to an embodiment of the invention, the direction control arrangement comprises a pivot arranged in a second fastening lug comprised by the first frame part which lug substantially allows only rotational motion. By means of the pivot, motion is prevented in non-desired directions and allowed in a desired direction.

The pivot comprises according to an embodiment at least two support parts being on planes intersecting on a joint intersection line.

According to an embodiment of the invention, the support parts comprise binder parts extending in the longitudinal direction of the support part at a distance from each other such that from each gap determined by the distance a binder part of another support part/other support parts used in pivoting can be brought through.

The elastic fastening comprises an elastic piece arranged between the first and the second frame part.

Other additional features characteristic of the invention are illustrated in the accompanying claims.

In this context, a paper machine means different fibrous web manufacturing or processing apparatuses or their sections, such as paper machines, board machines, press sections, reelers, calenders and slitter-winders. The invention is well applicable, inter alia, in connection with the carrier rolls and/or press rolls of the winding section of slitter-winders.

Other characteristic features of the method and apparatus according to the invention are illustrated in the accompanying claims.

The invention and its operation will now be described with reference to the accompanying schematic figures.

DESCRIPTION OF THE PREFERRED EMBODIMENTS

The rolls of the fibrous-web machine are typically supported from their ends in the frame or foundation of the machine. The structure of the roll can be such that it comprises a hollow shell and heads arranged to its ends in which head there further is a quite short shaft. Such a roll is rotatably supported by the above-mentioned shafts in the frame or foundation of the machine. The structure of the roll can also be such that it comprises a frame stationary when operated supportable to the frame from its ends and a shell rotatably arranged around it. In such a roll, the shell can even be to some extent elastic, and a shoe has been arranged inside it to support the shell, whereby the roll is often called a long-nip roll.

Figure 1:
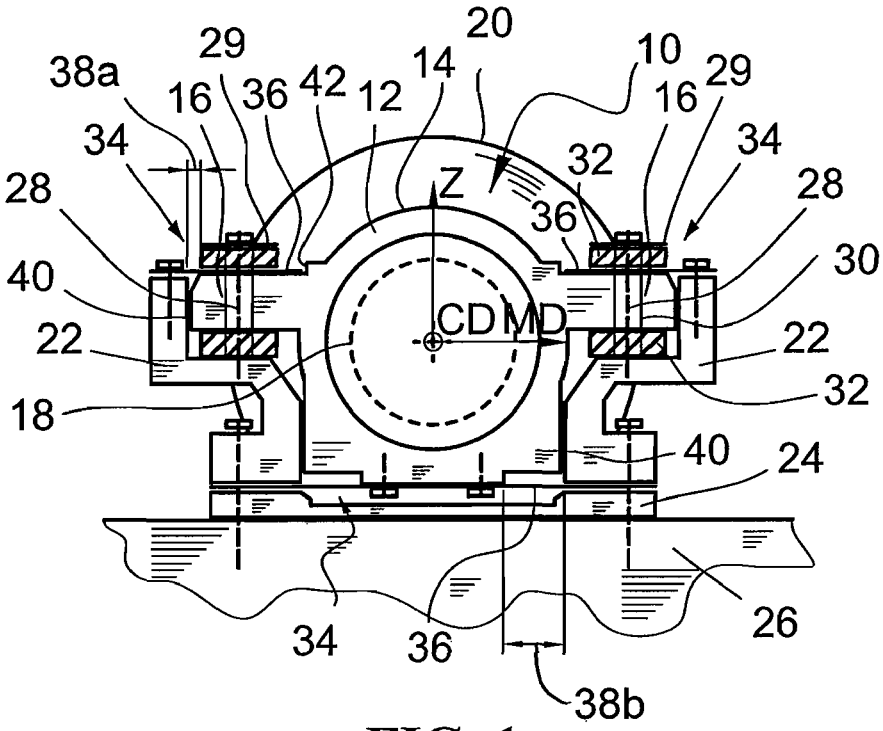
FIG. 1 shows a support arrangement of a roll according to an advantageous embodiment of the invention.

A support arrangement 10 of a roll of a fibrous-web machine according to an advantageous embodiment of the invention shown in connection with FIG. 1 comprises a first frame part 12 and a second frame part 22. Here, the first frame part 12 consists of a bearing housing 14 and fastening lugs 16 in connection with it. The fastening lugs 16 are arranged on the opposite sides of the bearing housing 14 extending from the bearing housing 14 substantially at opposite directions in a parallel plane with the longitudinal axis of the roll which is in FIG. 1 perpendicular in relation to the figure. FIG. 1 figuratively shows with a dashed line also a bearing arrangement 18 arranged into connection with the bearing housing 14 and a roll 20 which is rotatably supported in the bearing housing through the bearing arrangement 18. The bearing housing 14 supports itself in this embodiment to the second frame part 22 and through a third frame part 24 substantially rigidly in a frame or foundation 26 of the fibrous-web machine.

The first frame part 12 is fastened to the second frame part 22 by means of an elastic fastening. In this embodiment, it has been implemented in the following way. Through the fastening lugs 16 of the first frame part 12 is arranged a drawbar, bolt or equivalent 28, one or more. The bolt 28 extends through the fastening lug 16 and is fastened on the inner thread of an opening of the second frame part 22. Between a plate 29 between the fastening lug 16 and the head of the bolt 28 and the fastening lug 16 and the second frame part 22 are arranged elastic pieces 32 which enable elastic fastening. The bolts 28 are tightened against separate sleeves 30. The sleeves 30 extend from the plate 29 of the bolt 28 to the surface of the second frame part 22, whereby the length of the sleeve 30 here determines the compression of the elastic pieces 32. In order to be able to control the direction of the motion enabled by elasticity, there is a motion direction control arrangement 34 in the embodiment of FIG. 1.

To facilitate understanding the invention, it is possible in a practical situation to determine the so-called machine direction MD, cross direction CD and vertical direction Z, whereby the cross direction in the figure is perpendicular in relation to the plane of the figure. In the following description, these will also be used as assistance in indicating directions.

The motion direction control arrangement 34 comprises in the embodiment of FIG. 1 firstly thin support parts 36 connected to the support arranged through the fastening lugs 16. The support parts 36 are planar pieces which are advantageously manufactured of spring steel or equivalent. As an example of the size of the fastening lugs 16, three separate support parts of the thickness of 1 mm used in a test arrangement can be mentioned in which as the length of a deformation zone 38*a* was successfully used the length of 30-60 mm. Based on experiences, the deformation zone is at least 20 mm depending on the application. The total thickness of the support part is in practice at the most 15% of the length of its deformation zone 38*a*, whereby it is thus thin. The deformation zone is the zone for the part of which the support part 36 is free to deflect in use. The support part 36 is fastened by bolts or equivalent from the vicinity of its second edge to the second frame part 22 and, correspondingly, from the vicinity of the first edge to the first frame part 12, here between the elastic piece 32 and the fastening lug 16. The support part 36 then limits the direction of elasticity. The elastic fastening implemented by means of the bolts 28, the sleeves 30 and the elastic pieces 32 allows the elastic motion of the first frame part 12 mainly in the direction of the sleeve and the bolt and not substantially in other directions. For ensuring the prevention of the motion of the first frame part 12 and the roll 20 in the above-mentioned other directions, the bearing housing 14 comprises a shoulder 42 against which the support part 36 is arranged from its first edge. This prevents the motion between the support part 36 and the first frame part 12 and thus limits the motion of the first frame part 12 and the roll 20 in the direction of the plane of the support part 36 which here corresponds to the plane determined by the machine direction MD and the cross direction CD. Because the support part 36 is stationarily fastened from its ends to the first and the second frame part 12, 22, and because its width is relatively large, it also prevents the cross-directional CD motion. The direction of the plane of the support part 36 thus determines the directions in which the support part 36 particularly limits the motion. Because the fastening points of the first and the second edge of the support part to the first and the second frame part are at a distance from each other, deformation in the support part 36 can occur such that it deflects like a leaf spring. Then, the support part 36 allows the motion between the first and the second frame part 12, 22 substantially approximately in the perpendicular direction in relation to the plane of the support part. On the other hand, the motion of the first and the second frame part in the direction of the plane of the support part is mainly possible only within the elongation of the support part which is very minimal in practice.

In the embodiment of FIG. 1, below the bearing housing 14 there is a third support part 36 which extends to the second frame part 22 from its both ends and is fastened by its middle part with bolts on the lower surface of the first frame part 12 i.e. here the bearing housing. In this support part, the deformation length 38*b* is chosen slightly longer than that of the support parts in connection with the fastening lugs 16. Different support parts 36 can be provided with different characteristics, such as manufactured of different material in a way required by the application.

For minimizing the motion in the direction of the plane of the support part 36, the bearing housing i.e. the first frame part 12 and the second frame part 22 comprise control surfaces 40 substantially parallel to each other. The direction of the control surfaces joins the direction of the allowed motion and is substantially perpendicular in relation to the direction of the plane of the support part 36.

In this embodiment of FIG. 1, the basic arrangement is such that it operationally includes three parts: the first frame part 12 inside of which there is an actual roller bearing of the roll, the second frame part 22 which is fastened as rigidly as possible to the frame or foundation of the fibrous-web machine, and the elastic and damping support arrangement enabling the motion between these 12; 22.

Particularly in the carrier-roll applications of the winding sections of the slitter-winder, it is essential that clearances are minimized and the elastic motion takes place within the limits allowed by the elastic pieces. For maximizing the damping capacity of the bearing housing, the bearing housing is manufactured such that an as large as possible part of motion taking place due to dynamic load in the housing will occur in a part which damps vibration well.

It is thus essential to construct the support such that it is as much as possible supported by the damping part and the direction control arrangement in the direction of the motion of the vibration, sufficiently rigid in other directions and substantially clearance-free in all directions.

Typically, the support of the rolls of fibrous-web machines, e.g. a carrier roll of a slitter-winder, has to be statically at least so rigid in all directions that the lowest natural frequencies of the roll are somewhat higher than the greatest rotational frequency of the roll.

Figure 2:
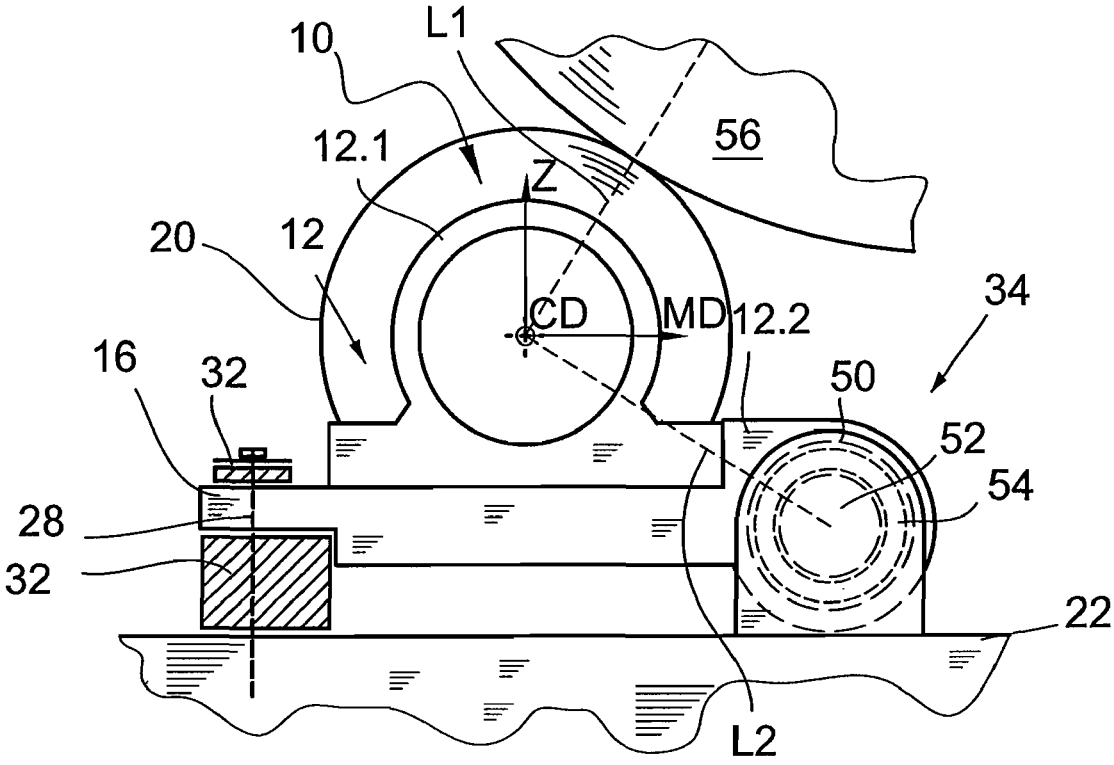
FIG. 2 shows a second support arrangement of a roll according to an advantageous embodiment of the invention.

FIG. 2 shows another embodiment of a support arrangement 10 of a roll according to the invention. Here, the first frame part 12 comprises two main parts which are a fastening part 12.1 of the end of the roll and a fastening bar 12.2. The fastening part of the end of the roll 20 can be constructed such that it enables the fastening of the roll end stationarily, whereby the roll being used can be e.g. a deflection-compensated roll. It is evident that the first frame part 12 can be constructed to comprise a bearing housing, whereby the rotatable shaft of the roll end is fastened in the bearing.

The first frame part 12 is fastened to the second frame part 22 by means of an elastic fastening. In this embodiment, the elastic fastening has been implemented such that the first end of the first frame part 12 is fastened by the bolt joint 28 to the second frame part 22 such that the fastening lug 16 of the first frame part is tightened by one or more bolts 28 between the elastic pieces 32.

In the embodiment of FIG. 2, the motion direction control arrangement 34 comprises a pivot 50 arranged in the second fastening lug. The pivot comprises a pin or equivalent 52 fastened in the fastening lug by its ends and a bearing or sleeve 54 arranged in the fastening lug. Also in this context, it is possible to determine the so-called machine direction MD, cross direction CD and vertical direction Z, whereby the cross direction in the figure is perpendicular in relation to the plane of the figure. Then, rotational motion around the longitudinal axis of the pin 52 is possible for the first frame part 12. Clearances between the pin 52 and the sleeve 54 are chosen in practice small enough, whereby the machine-directional MD and vertical Z motion is practically prevented. In practice, the rotational motion is so little that the motion conveyed by the first frame part 12 for the elastic pieces 32 of its second end is almost linear. Due to the effect of the pivot 50, the first frame part 12 can thus move in relation to the second frame part 22 substantially only in one direction.

In practice, the direction in which motion is allowed is chosen case-specifically. It can be e.g. precisely the vertical direction. FIG. 2 shows as an example a situation in which the roll 20 supports a paper reel 56. Then, the position of the pivot 50 is chosen such that a straight line L1 drawn via the nip of the reel 56 and the center of the roll can be arranged perpendicular in relation to a straight line L2 passing the centers of the pivot and the roll.

Figure 3:
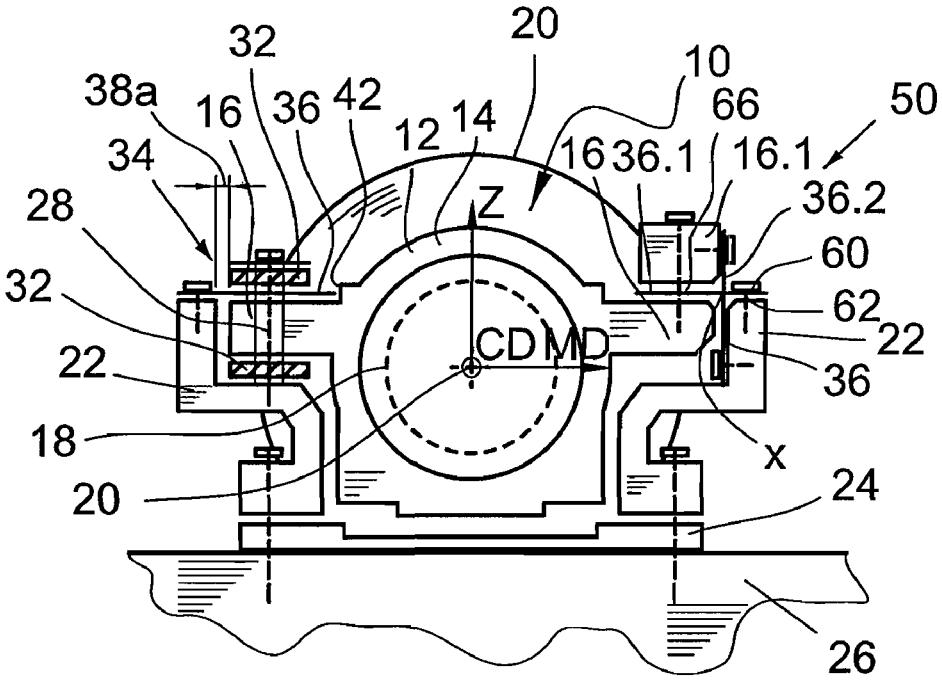
FIG. 3 shows a third support arrangement of a roll according to an advantageous embodiment of the invention.

FIG. 3 shows a third embodiment of the invention. Here, the support arrangement 10 of the roll of the fibrous-web machine comprises the first frame part 12 and the second frame part 22. The first frame part consists here of the bearing housing 14 and the fastening lugs 16 in connection with it. The fastening lugs are arranged on the opposite sides of the bearing housing 14 extending from the bearing housing at opposite directions in a parallel plane with the longitudinal axis of the roll which longitudinal axis is in FIG. 3 perpendicular in relation to the figure. FIG. 3 figuratively shows with a dashed line also the bearing arrangement 18 arranged in the bearing housing and the roll 20 which is rotatably supported in the bearing housing through the bearing arrangement 18. The bearing housing supports itself in this embodiment to the second frame part 22 and through the third frame part 24 to the frame or foundation 26 of the fibrous-web machine.

The first fastening lug 16 of the bearing housing, which is in FIG. 3 on the left side, is provided with the elastic fastening of the fastening lug 16 shown in FIG. 1. There, the fastening lug has been fastened with the bolt joint 28 to the second frame part 22 supported between the elastic pieces 32. In FIG. 3, the motion direction control arrangement 34 on the left comprises firstly the thin support part 36 connected to the support arranged through the fastening lugs 16. The support part 36 is thus a planar thin piece which is advantageously manufactured of spring steel or equivalent. The support part 36 is fastened by bolts or equivalent from the vicinity of its second edge to the second frame part 22 and, correspondingly, from the vicinity of the first edge to the first frame part 12, here between the elastic piece 32 and the fastening lug 16. The support part 36 limits the direction of elasticity. For ensuring the positioning of the support part 36, the bearing housing 14 comprises the shoulder 42 against which the support part is arranged from its first edge. This prevents the motion between the support part 36 and the first frame part 12 and thus limits the motion of the first frame part and the roll in the direction of the plane which here corresponds to the plane of the machine direction MD and the cross direction CD. Because the support part 36 is stationarily fastened from its ends to the first and the second frame part and because its width is relatively large, it also prevents the cross-directional CD motion in addition to the machine direction motion. The direction of the plane of the support part 36 thus determines the directions in which the support part particularly limits the motion. Because the fastening points of the first and the second edge of the support part 36 to the first and the second frame part 12; 22 are at a distance from each other, deformation in the support part 36 can occur such that it deflects like a leaf spring. Then, the support part 36 allows the motion between the first and the second frame part substantially approximately in the perpendicular direction in relation to the plane of the support part.

In the embodiment of FIG. 3, the second fastening lug (on the right in the figure) is pivoted in a special way to the second frame part 22. Operationally from the viewpoint of the invention, the pivoting 50 of FIG. 3 corresponds to the pivot 50 shown in FIG. 2, but its structure is different. The pivoting of FIG. 3 is totally clearance-free, whereby it is particularly well suitable for supporting the carrier roll of the winding section of the slitter-winder and for other such targets in which the accurate positioning of the roll is particularly important.

The pivoting according to the invention shown in FIG. 3 will be described in the following with reference to FIGS. 3 and 6. The pivoting is based on two or more thin support parts 36 arranged on planes intersecting each other. A pivot shaft X of the pivot formed thus is on the intersection line of the planes. The support parts 36 forming the pivot comprise a first fastening zone 60 extending in the cross-direction of the support part over which zone are arranged holes 62 for the fastening at a distance from each other. On the fastening zone, there are arranged several binder parts 64 extending in the longitudinal direction of the support part also at a distance from each other. The distance between the binder parts 64 is chosen such that from each gap it is possible to bring through a binder part of other support parts 36 used in the pivoting. The direction of the binder parts determines the direction of each support part in which its elasticity is particularly minimal. In the binder parts, the deformation zone 38*a* of the pivoting according to the invention is arranged.

Figure 6:
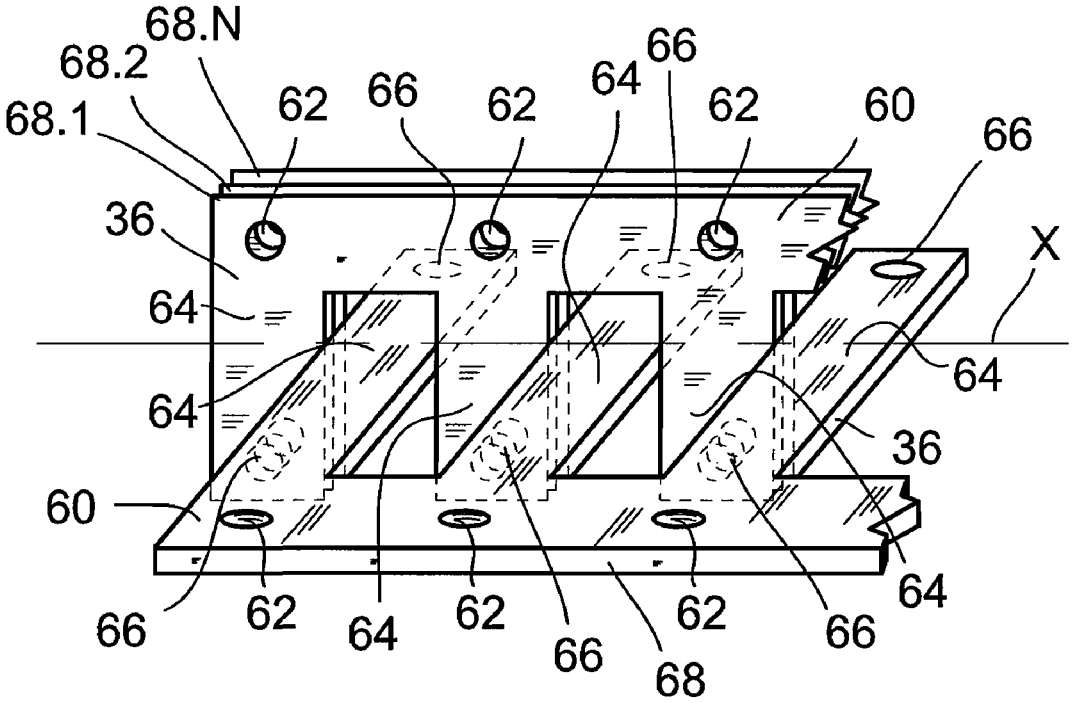
FIG. 6 shows an embodiment of binder pieces according to the invention.

At the end of each binder part in the embodiment of FIG. 6, there is a hole 66 by means of which each binder part and thus support part in its whole can be fastened from its other end. The binder part 64 is thin in the direction of the normal of the deformation zone, whereby it is able to deflect relatively easy, but wide on the plane of the deformation zone, whereby the support part and the pivot formed thus of the support parts is substantially rigid apart from the pivot function.

The support part can be formed of one plate 68 or a stack formed by several single plates 68.1, 68.2, 68.N on top of each other. Both ways are usable as such, but the stack of plates enables the greater deflection of the pivot i.e. it is possible to arrange the rotational angle larger by using the stack of plates.

In the pivot 50 shown in FIG. 3, a support part 36.1 on the first plane is rigidly fastened from its first end i.e. from its fastening zone 60 with bolts to the second frame part 22. The binder parts 64 of the support part extend between the fastening lug 16 and the fastening piece 16.1 in which the bolts arranged through the hole 66 of the binder part tighten the other end of the support piece. A support part 36.2 on the second plane is correspondingly fastened from its first end to the second frame part and from its second end to the fastening piece 16. Here, the planes are perpendicular against each other. Then, a pivot is formed which allows rotation on the intersection line X of the plane, but is substantially rigid in other directions.

By the length of the deformation zone, i.e. the zone for the part of which the support part, or in more detail its binder part, is free to deflect in the installation, the rigidity of the pivoting can be affected, among others.

Figure 4:
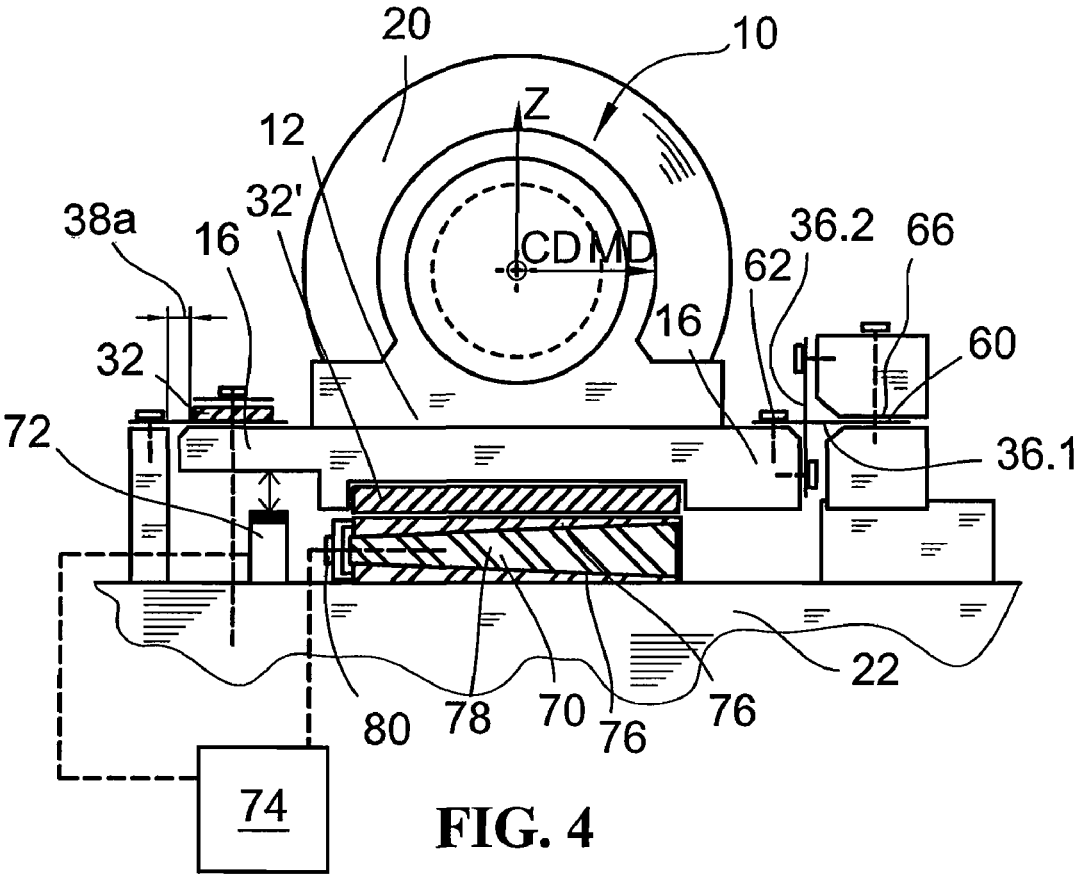
FIG. 4 shows a fourth support arrangement of a roll according to an advantageous embodiment of the invention.

In FIG. 4, the operation of the pivot between the first frame part 12 and the second frame part 22 corresponds to the one shown in FIG. 3. Here are arranged two support parts arranged on planes intersecting each other, the deformation zone of which is utilized in providing the pivoting, based on the principle shown in FIGS. 3 and 6.

The first fastening lug 16 of the first frame part 12 is also here tightened with the bolt 28 between elastic pieces 32 and 32'. The elastic piece 32 above the fastening lug is arranged here into connection with the bolt, but the elastic piece 32' below is on the lower surface of the first frame part 12 so that the bolt does not go through it. Between the elastic piece 32' below and the second frame part 22 (the order can also be reversed), there is a distance adjustment apparatus 70. By the distance adjustment apparatus, the position between the first 12 and the second frame part 22 can be adjusted in relation to each other. Such a requirement can be in some targets of application process-technical adjustment, such as that of nip force, but principally its purpose is to compensate the permanent deformations of the elastic pieces which can occur during use as time passes. The arrangement also comprises a distance or position sensor 72 based on the measuring data of which the distance adjustment apparatus is adjusted and the position of the first 12 and the second frame part 22 in relation to each other is set. The arrangement can also comprise a control unit 74 which receives the measuring data of the distance or position sensor 72 and processes it e.g. by sending a measurement value to be viewed on the control apparatus, by alarming of a distance going outside set values or by directly controlling the distance adjustment apparatus 70 by a correcting measure.

The distance adjustment apparatus 70 comprises in this embodiment two pieces 76 on top of each other the corresponding surfaces of which are inclined in different directions forming a wedge-shaped gap. Into this gap, a wedge piece 78 is arranged. At the narrower end of the wedge piece, there is a screw device 80 which, when being tightened, is arranged to provide pull in the wedge piece causing counter force in the pieces 76 being on top of each other on its opposite sides. This provides the motion of the wedge piece in the gap in relation to the pieces 76 and, from the effect of their shapes, the motion of the pieces 76 farther from each other and further the motion of the first frame part farther from the second frame part. The arrangement also operates in a corresponding way in the other direction.

Figure 5:
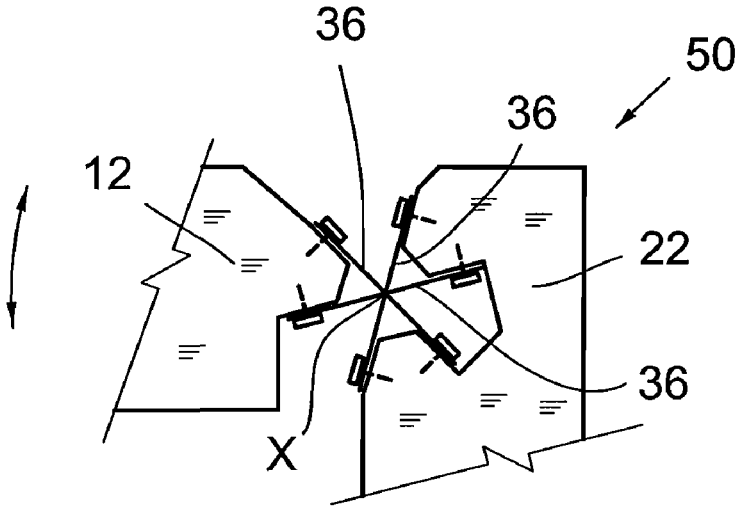
FIG. 5 shows an embodiment of pivoting according to the invention.

FIG. 5 shows an embodiment of the pivoting 50 according to the invention. In this embodiment, the pivoting between the first frame part 12 and the second frame part 22 is provided by using three support parts 36 intersecting each other on the same plane. Also here, the pivot shaft is on the intersection line X of the planes.

Figure 7:
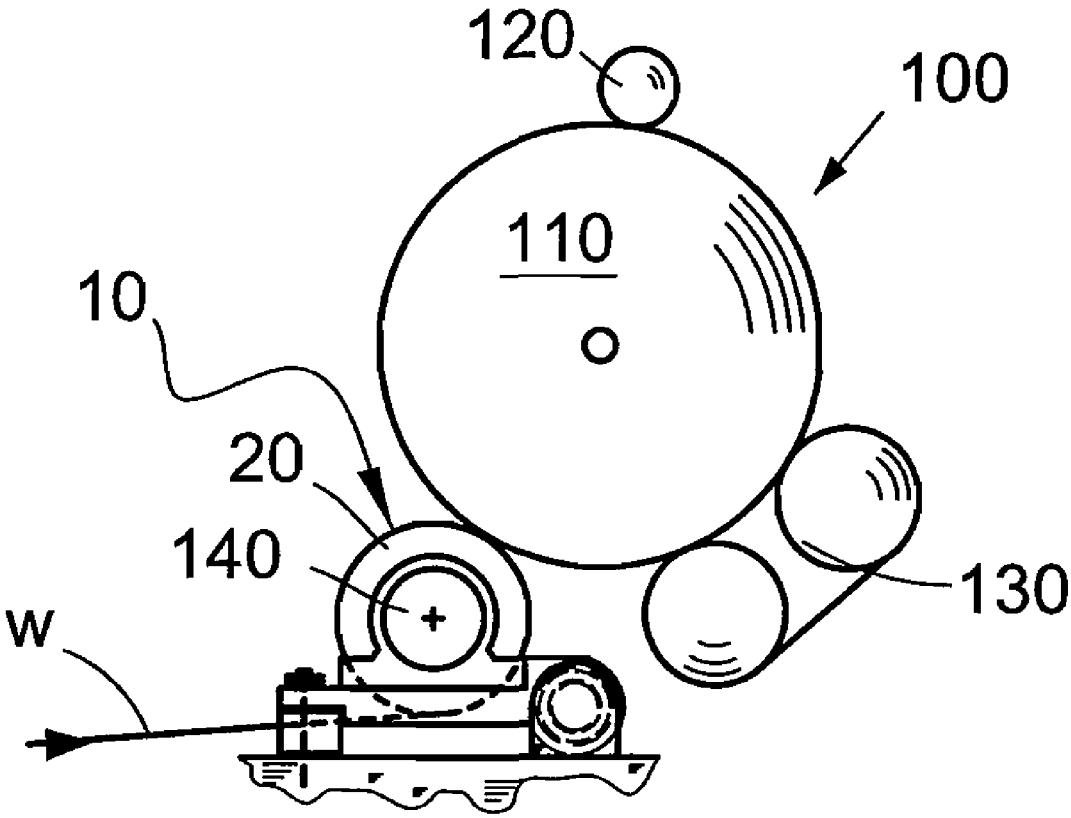
FIG. 7 shows a support arrangement of a roll according to the invention applied in the winding section of a slitter-winder.

FIG. 7 shows a support arrangement 10 of a roll according to the invention applied in a winding section 100 of a slitter-winder of a fibrous web. Here, the winding section is a carrier-roll winder in which the roll 20 is arranged as a front roll 140. In the winder, the fibrous web w is guided through the roll 20 into a web reel 110 which is supported also by a set of belt rolls 130 and a press roll 120. Also the support of the press roll 120 can comprise a support arrangement according to the invention.

It should be noticed that only a few of the most advantageous embodiments of the invention were described above. Thus, it is evident that the invention is not limited to the above-mentioned embodiments, but it can be applied in many ways within the scope defined by the enclosed claims. Also, characteristics described in connection with different embodiments can be used in other embodiments if technical possibilities exist.

We claim:

1. A roll support assembly of a fibrous-web machine, comprising:

a first frame part;

a roll having an end which is supported on the first frame part;

a second frame part which is fastened to the first frame part by an elastic fastening extending in a first direction which extends from the first frame part to the second frame part;

a motion direction control mechanism which controls the motion allowed by the elastic fastening, said mechanism allowing the elastic motion of the first frame part mainly in the first direction and not substantially in other directions;

wherein the elastic fastening comprises an elastic element positioned between portions of the first frame part and the second frame part;

a fastener which extends through the first frame part, and the second frame part in a first direction to elastically fasten the first frame part to the second frame part;

wherein the motion direction control mechanism is a first support part which is a thin metal sheet, the first support part being fastened between the first frame part and the second frame part, and extending in a second direction between the first frame part and the second frame part, the second direction being different than the first direction, the first support part extending across a deformation zone defining a width between the first frame part and the second frame part, in which the first support part is free to deflect in use in the first direction, while the first support part restricts motion in the second direction; and wherein the support part has a thickness in the first direction which is at most 15 percent of the width of the deformation zone in the second direction.

2. The roll support assembly of claim 1, further comprising:

portions of the first support part which define a fastening zone which is secured, and a plurality of binder parts which extend in the second direction, the plurality of binder parts being spaced from each other to define first gaps; and a second support part having portions which define a fastening zone which is secured, and a plurality of binder parts which extend in a direction other than the second direction, said second support part binder parts being spaced from each other to define second gaps, such that said second support part binder parts pass through the first gaps.

3. The roll support assembly of claim 1, wherein the roll is arranged in a winding section of a slitter-winder of a fibrous-web machine.

4. The roll support assembly of claim 3, wherein the roll is a carrier or a press roll.

5. The roll support assembly of claim 1 wherein the roll extends in a cross direction and has an end which is supported on the first frame part, wherein a machine direction is defined perpendicular to the cross direction; and wherein the motion direction control mechanism further comprises:

a first fastening lug which extends from the first frame part in the machine direction;

a second fastening lug which extends from the first frame part and which is spaced in the machine direction from the first fastening lug;

an elastic element positioned between portions of the first frame part first fastening lug and the second frame part;

wherein the fastener which extends through the first frame part and the second frame part extends through, the elastic element in the first direction to elastically fasten the first frame part to the second frame part; and a pivot arranged in the second fastening lug which connects the first frame part to the second part and substantially allows only rotational motion therebetween.

6. The roll support assembly of claim 5, wherein the pivot comprises at least two support parts being on planes intersecting each other on a joint intersection line.

7. The roll support assembly of claim 6, wherein the at least two support parts comprise:

a first support part having portions which define a fastening zone which is secured, and a plurality of binder parts which extend in a second direction which is different than the first direction, the plurality of binder parts being spaced from each other to define first gaps; and a second support part having portions which define a fastening zone which is secured, and a plurality of binder parts which extend in a direction other than the second direction, said second support part binder parts being spaced from each other to define second gaps, such that said second support part binder parts pass through the first gaps.

8. The roll support assembly of claim 1, wherein the fastener which extends through the first frame part, and the second frame part extends through the elastic element in the first direction to elastically fasten the first frame part to the second frame part.

9. The roll support assembly of claim 1, wherein the first frame part comprises a fastening part of the roll end and a first fastening lug, and wherein the motion direction control mechanism is arranged in connection with the first fastening lug.

10. The roll support assembly of claim 9, wherein the first frame part further comprises a second fastening lug and that the motion direction control mechanism comprises a pivot arranged in the second fastening lug which substantially allows only rotational motion.

11. The roll support assembly of claim 10, wherein the pivot comprises at least two support parts being on planes intersecting each other on a joint intersection line.

12. The roll support assembly of claim 11, wherein the support parts comprise binder parts at a distance from each other such that from each gap determined by the distance it is possible to bring through a binder part of other support parts used in the pivoting.

13. The roll support assembly of claim 1, wherein the first frame part comprises a bearing housing, and wherein a first fastening lug and a second fastening lug extend substantially in opposite directions from the bearing housing and that both the first fastening lug and the second fastening lug are provided with the motion direction control mechanism.

14. A roll support assembly of a fibrous-web machine, comprising:

a first frame part;

a roll having an end which is supported on the first frame part;

a second frame part which is fastened to the first frame part by an elastic fastening extending in a first direction which extends from the first frame part to the second frame part;

a motion direction control mechanism which controls the motion allowed by the elastic fastening, said mechanism allowing the elastic motion of the first frame part mainly in the first direction and not substantially in other directions;

wherein the elastic fastening comprises an elastic element positioned between portions of the first frame part and the second frame part;

a fastener which extends through the first frame part, the elastic element, and the second frame part in a first direction to elastically fasten the first frame part to the second frame part;

wherein the motion direction control mechanism is a first support part which is a thin metal sheet, the first support part being fastened between the first frame part and the second frame part, and extending in a second direction between the first frame part and the second frame part, the second direction being different than the first direction, the first support part extending across a deformation zone defining a width between the first frame part and the second frame part, in which the first support part is free to deflect in use in the first direction, while the first support part restricts motion in the second direction; and wherein the second direction is perpendicular to the first direction.

15. A roll support assembly of a fibrous-web machine, comprising:

a first frame part;

a roll having an end which is supported on the first frame part;

a second frame part which is fastened to the first frame part by an elastic fastening extending in a first direction which extends from the first frame part to the second frame part;

a motion direction control mechanism which controls the motion allowed by the elastic fastening, said mechanism allowing the elastic motion of the first frame part mainly in the first direction and not substantially in other directions;

wherein the elastic fastening comprises an elastic element positioned between portions of the first frame part and the second frame part;

a fastener which extends through the first frame part, the elastic element, and the second frame part in a first direction to elastically fasten the first frame part to the second frame part;

wherein the motion direction control mechanism is a first support part which is a thin metal sheet, the first support part being fastened between the first frame part and the second frame part, and extending in a second direction between the first frame part and the second frame part, the second direction being different than the first direction, the first support part extending across a deformation zone defining a width between the first frame part and the second frame part, in which the first support part is free to deflect in use in the first direction, while the first support part restricts motion in the second direction;

wherein the first frame part comprises a bearing housing, and wherein a first fastening lug and a second fastening lug extend substantially in opposite directions from the first frame part, and wherein both the first fastening lug and the second fastening lug are provided with support parts fastened between the first frame part and the second frame part, and extending in its own support part direction, each of the support parts being free to deflect in use in the first direction, while restricting motion in each support part's own direction.

* * * * *